US007766168B2

(12) United States Patent
Thrapp et al.

(10) Patent No.: US 7,766,168 B2
(45) Date of Patent: Aug. 3, 2010

(54) TWO-PIECE, EASY ACCESS CONTAINER

(75) Inventors: Stephen R. Thrapp, Fort Collins, CO (US); Douglas P. Collins, Loveland, CO (US); Kenneth W. House, Fort Collins, CO (US)

(73) Assignee: Piopodco, LLC, Fort Collins, CO (US)

( * ) Notice: Subject to any disclaimer, the term of this patent is extended or adjusted under 35 U.S.C. 154(b) by 288 days.

(21) Appl. No.: 11/771,102

(22) Filed: Jun. 29, 2007

(65) Prior Publication Data

US 2008/0041851 A1 Feb. 21, 2008

Related U.S. Application Data

(63) Continuation-in-part of application No. 11/428,730, filed on Jul. 5, 2006, now abandoned.

(51) Int. Cl.
*B65D 73/00* (2006.01)

(52) U.S. Cl. ..... 206/496; 206/37; 206/315.11; 220/229

(58) Field of Classification Search ..... 206/37, 206/37.1, 38, 38.1, 315.11, 496; 220/229, 220/293, 296

See application file for complete search history.

(56) References Cited

U.S. PATENT DOCUMENTS

| | | | |
|---|---|---|---|
| 2,213,465 | A | 9/1940 | Gay |
| 2,436,291 | A | 2/1948 | Daniel |
| 4,600,112 | A | 7/1986 | Shillington et al. |
| 4,765,459 | A | 8/1988 | Edwards |
| 5,165,564 | A | 11/1992 | Prout et al. |
| 6,234,338 | B1 | 5/2001 | Searle |
| 6,273,309 | B1 | 8/2001 | Oppelt |
| 6,656,514 | B1 | 12/2003 | Tubbs |
| 2005/0139596 | A1 | 6/2005 | Yabusaki |
| 2005/0263523 | A1 | 12/2005 | Moss |
| 2006/0131308 | A1 | 6/2006 | Drake |

OTHER PUBLICATIONS

Mossworld Enterprises, Inc. Product Testing. The Snack Trap. www.mossworld.com. Apr. 20, 2007.US.

(Continued)

*Primary Examiner*—J. Gregory Pickett

(57) ABSTRACT

Containers which may be worn by a user and into which small refuse items and other materials can be inserted for temporary storage or for later disposal using one or more fingers of one hand, are described. In one embodiment, a hollow body having a closed end and an open screw cap cooperate to hold a deformable septum having a slit or perforation such that small items may easily be inserted into the body through the slit wherein they are securely enclosed until the body is detached from the cap. The contents can then be disposed of in an acceptable manner or otherwise used. In another embodiment of the invention, the screw cap and septum are replaced by a cover closed at one end and having a slit or opening having radially disposed arms in the closed end for introducing materials into the hollow body through the slit. Larger containers may be set into cup holders for use. Among the uses of the invention is the secure storage of waste fishing line and other discarded articles along streams and lakefronts for later disposal.

3 Claims, 14 Drawing Sheets

OTHER PUBLICATIONS

Litterbuggy. Environmental Litter Tidy. www.litterbuggy.com. Apr. 22, 2007.UK.

The Press. Tidy devise wins award; Nov. 23, 2004. http://archive.yorkpress.co.uk. Apr. 23, 2007 UK.

International Search Report for PCT/US07/72495, International Searching Authority, Aug. 21, 2008, p. 1-4.

TWO-PIECE, EASY ACCESS CONTAINER

RELATED CASES

The present patent application is a continuation-in-part application of copending U.S. patent application Ser. No. 11/428,730 for "EASY ACCESS REFUSE CONTAINER" which was filed on Jul. 5, 2006 by Stephen R. Thrapp, the disclosure and teaching of which are hereby incorporated by reference herein.

FIELD OF THE INVENTION

The present invention relates generally to containers and, more particularly, to a container into which refuse or other materials may be securely introduced using one hand.

BACKGROUND OF THE INVENTION

Fishermen routinely generate waste leader and other line in the course of fishing activities as a result of knots or tangles forming therein, as an example. Because of the difficulty in undoing such knots or tangles, the unusable leader is often cut free from the remainder of the leader and the fly or lure reattached to an unknotted portion thereof, or the leader is retied. Attempts to place the resulting waste leader into a vest or jacket pocket using wet hands or under in windy or otherwise inclement conditions often results in the refuse line being dropped or blown away. Such refuse line is harmful to fish and other wildlife, particularly waterfowl, when left in remote areas.

Environmentally conscious fishermen and other outdoorsmen may also wish to collect other refuse items for later disposal, such as cigarette butts, chewing gum, candy wrappers, and the like discarded by others, without soiling the pockets of fishing vests or other outdoor apparel.

Accordingly, it is an object of the present invention to provide a container which can be used to securely store fishing and other refuse until it can be properly disposed of, or store other materials.

Another object of the invention is to provide a container which can be used to securely store fishing and other refuse until it can be properly disposed of, or store other materials, such that the materials may be introduced into the container using one hand.

Yet another object of the invention is to provide a container which can be used to securely store fishing and other refuse until it can be properly disposed of, or store other materials, such that the container may be operably worn by the user thereof.

Additional objects, advantages and novel features of the invention will be set forth in part in the description that follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the container hereof includes: a hollow body having an open end and a closed end, an inner surface and an outer surface, the outer surface having a circular lip formed in the vicinity of the open end of the body;

and a cover having a closed end and an open end, a portion of the closed end being adapted for covering the open end of the body, the cover further being deformable and having a slit therethrough through which items can be inserted, having an extended portion through which a hole is placed for attaching the cover to other objects, and having a cylindrical inner surface in which a circumferential groove is disposed and adapted to receive the circular lip in the hollow body, whereby the cover is removably attached to the hollow body.

Benefits and advantages of the present invention include, but are not limited to, an apparatus which can be worn by a user or deployed in a cup holder located in a car or boat, as examples, and into which small items can be inserted for storage and/or for later disposal, using one or more fingers of one hand.

BRIEF DESCRIPTION OF THE DRAWINGS

The accompanying drawings, which are incorporated in and form a part of the specification, illustrate embodiments of the apparatus of the present invention and, together with the description, serve to explain the principles of the invention. In the drawings:

FIG. 2A is a schematic representation of a perspective view of the assembled refuse container of the present invention shown in FIG. 1A hereof, while

FIG. 4A is a schematic representation of a side view of another embodiment of the present invention, illustrating a cap having a funnel-shaped opening for facilitating introduction of materials into the container body through the septum or diaphragm, while

FIG. 5A is a schematic representation of a perspective view of still another embodiment of the container of the present invention illustrating a cylindrical body having an open end, a cover adapted to be detachably affixed to the open end of the body having a Y-shaped opening in the closed end thereof for inserting materials therethrough, and a split ring for attachment of the container to a zipper, tab, D-ring, and the like, while

DETAILED DESCRIPTION OF THE INVENTION

Briefly, one embodiment of the present invention includes a container which may be worn by a user and into which small items can be inserted for temporary storage for later secure disposal or other usage, using one or more fingers of one hand. A hollow body and a cap having openings at both ends cooperate to hold a deformable septum or diaphragm having a slit or perforation such that small items can easily be inserted into the cylindrical body through the slit wherein they are securely enclosed until the body is removed from the cap and septum which remain attached to a zipper, tab, ring, or D-ring, and the like, located on the user. The contents can then be disposed of in an acceptable manner, or otherwise used.

In another embodiment of the invention, the cap and septum are integrated into a single unit as a cover having a closed end. A Y-shaped slit through the closed end of the cover forms three wedge portions or sectors therein which may have optional ribs to provide suitable stiffness to the wedge portions. Optional teeth may be also be added to the wedge portions to assist in the removal of discarded fishing line from one or more fingers of one hand. An orifice in the vicinity of the center or axis of the Y-shaped slit may be added to increase the scraping or scrubbing action of the sectors on inserted digits of a user as they are removed from the slit, and to enable easy insertion of cigarette butts and other small objects.

In still another embodiment of the invention, a cover bearing a double Y-shaped slit configuration where one leg of each Y-shaped slit is collinear with a corresponding leg of the other slit. As in the previous embodiment, a hole may be placed along the collinear legs for ready insertion of cigarette butts and to increase the scraping or scrubbing action of the slit. Further, stiffening ribs and teeth may be optionally added. The double-Y-shaped slit configuration is adaptable to a larger container design, where several fingers of one hand may be inserted into the opening. Such larger containers might be suitable for insertion into cup holders and the like disposed in boats or cars, as examples, rather than being worn by the user thereof.

Clearly, many slit designs, container sizes and uses for the invention may be envisioned.

Figure 1A:
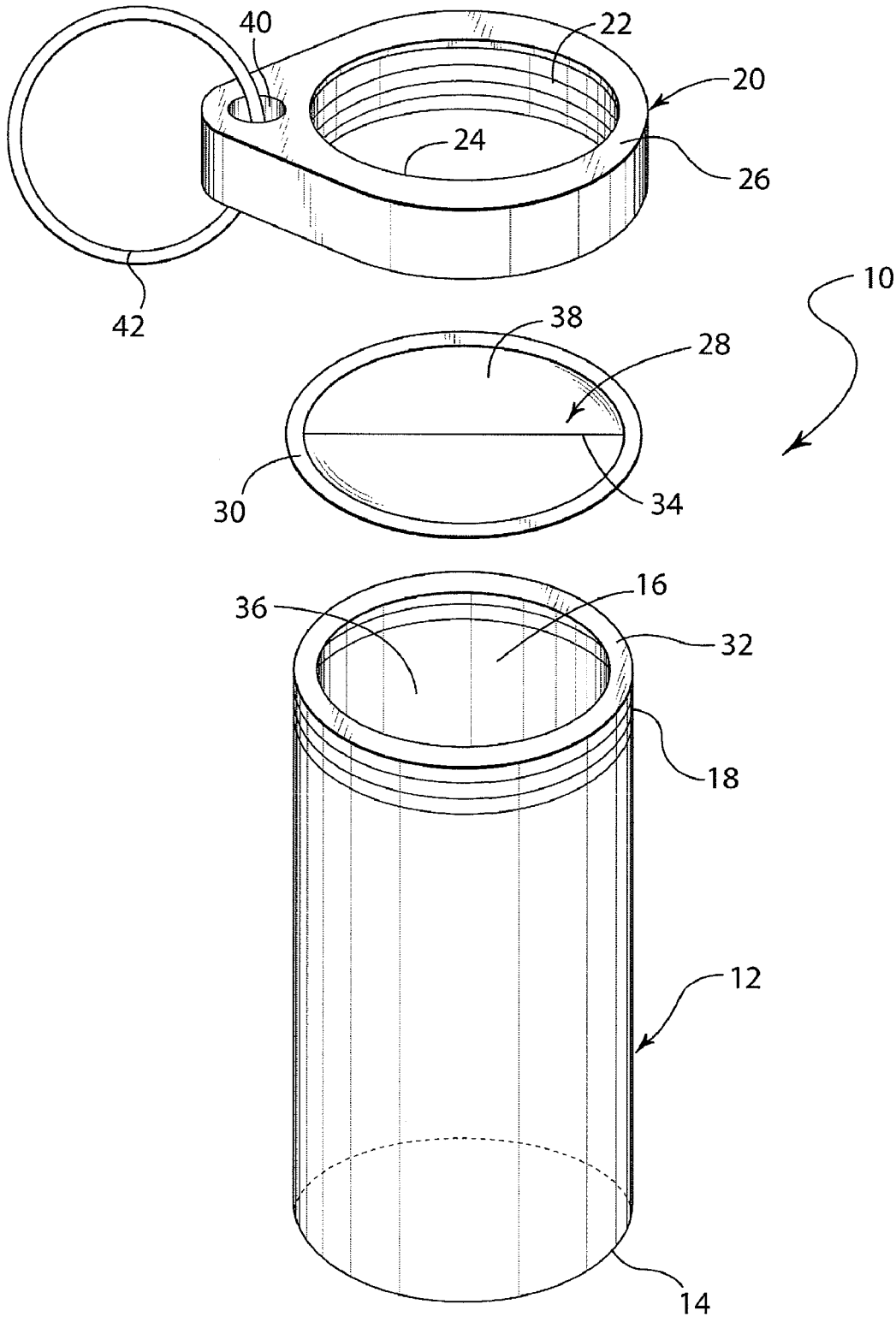
FIG. 1A is a schematic representation of an exploded perspective view of the container of the present invention showing a cylindrical body, a split-opening septum or diaphragm, a cap adapted to be screwed onto a threaded portion at the open end of the body, and a split ring for attachment to a zipper, tab, D-ring, and the like, FIG. 1B is a schematic representation an exploded projection view of the refuse container shown in FIG. 1A hereof, illustrating a septum having a cut or split in the shape of a cross or an "x", and the container body having a rounded interior at the closed end thereof.

Reference will now be made in detail to the present embodiments of the present invention, examples of which are illustrated in the accompanying drawings. In the drawings, similar or identical structure is identified using identical call-outs. Turning now to the FIGURES, FIG. 1A is a schematic representation of an exploded perspective view of one embodiment of container, 10, of the present invention showing a cylindrical body, 12, having closed end, 14, open end, 16, and threaded portion, 18, on the outer surface thereof in the vicinity of open end, 16. Open cylindrical cap, 20, is interiorly threaded, 22, such that cap 20 may be screwed onto cylindrical body 12. Cylindrical body 12 and cap 20 may be constructed from moldable rigid plastics, or metals. Substantially flat interior portion, 24, of flange, 26, of cap 20 is adapted to reversibly affix septum, diaphragm or wafer, 28, by means of a circumferential rib or bulbous portion or other stiffening portion, 30, against substantially flat portion, 32, at open end 16 of body 12 when cap 20 is screwed onto body 12, as will be described in more detail hereinbelow. Septum, 28, includes slit, cut or perforation, 34, therethrough adapted for inserting small objects into the interior, 36, of body 12, using a finger or other elongated object, while preventing such objects from exiting body 12 once the finger or other elongated body is removed therefrom and the perforation reforms unbroken surface, 38, of septum 28. Septum 28 may be made from polyethylene, neoprene or other soft, but resilient material.

Cap 20 may further include hole, 40, in an extended portion, 43, thereof, for attaching a carrying mechanism to the cap, such as metal or plastic split ring, 42, or other hardware, such as carabiners, snap hooks and the like. This allows container 10 to be tethered to a zipper pull or D-ring or other attachment hardware on a fishing vest of a user, or to a belt loop of the user, as examples, for easy access. It should be mentioned that it may be advantageous to attach the present container to a personal water craft.

Figure 1B:
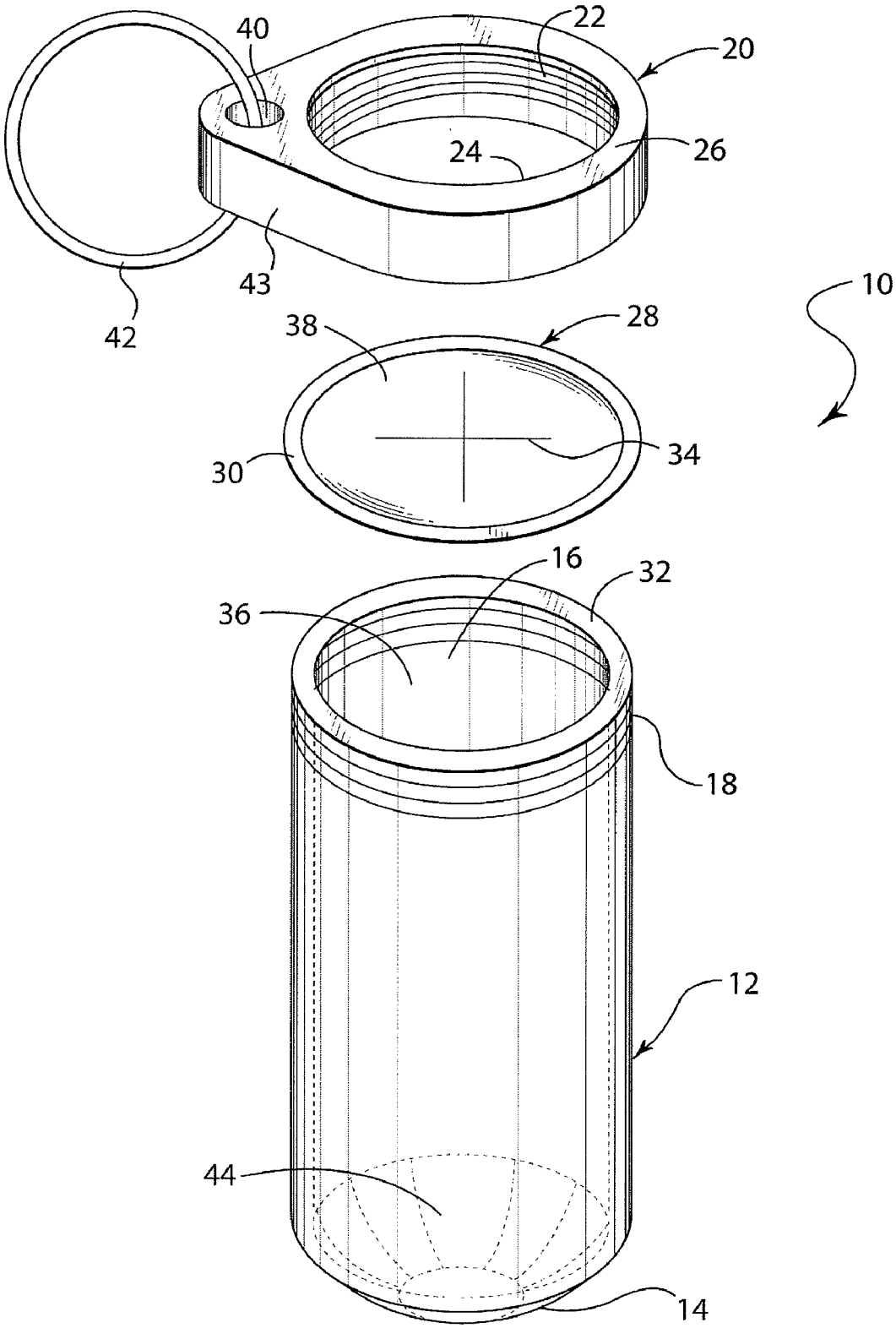
FIG. 1C is a schematic representation of an exploded perspective view of another embodiment of the refuse container of the present invention, illustrating the septum having a modified nipple shape with a x-shaped cut therein, with the cap being adapted to be attached to the body using a twist-lock attachment mechanism.
FIG. 1D is a schematic representation of a side view of the refuse container shown in FIG. 1C hereof.

FIG. 1B is a schematic representation of container 10 shown in FIG. 1A hereof, illustrating septum 28 having slit, cut or perforation, 34, therethrough in the shape of a cross or "x", and body 12 having rounded, closed end 14 with rounded interior portion, 44.

Figure 1C:
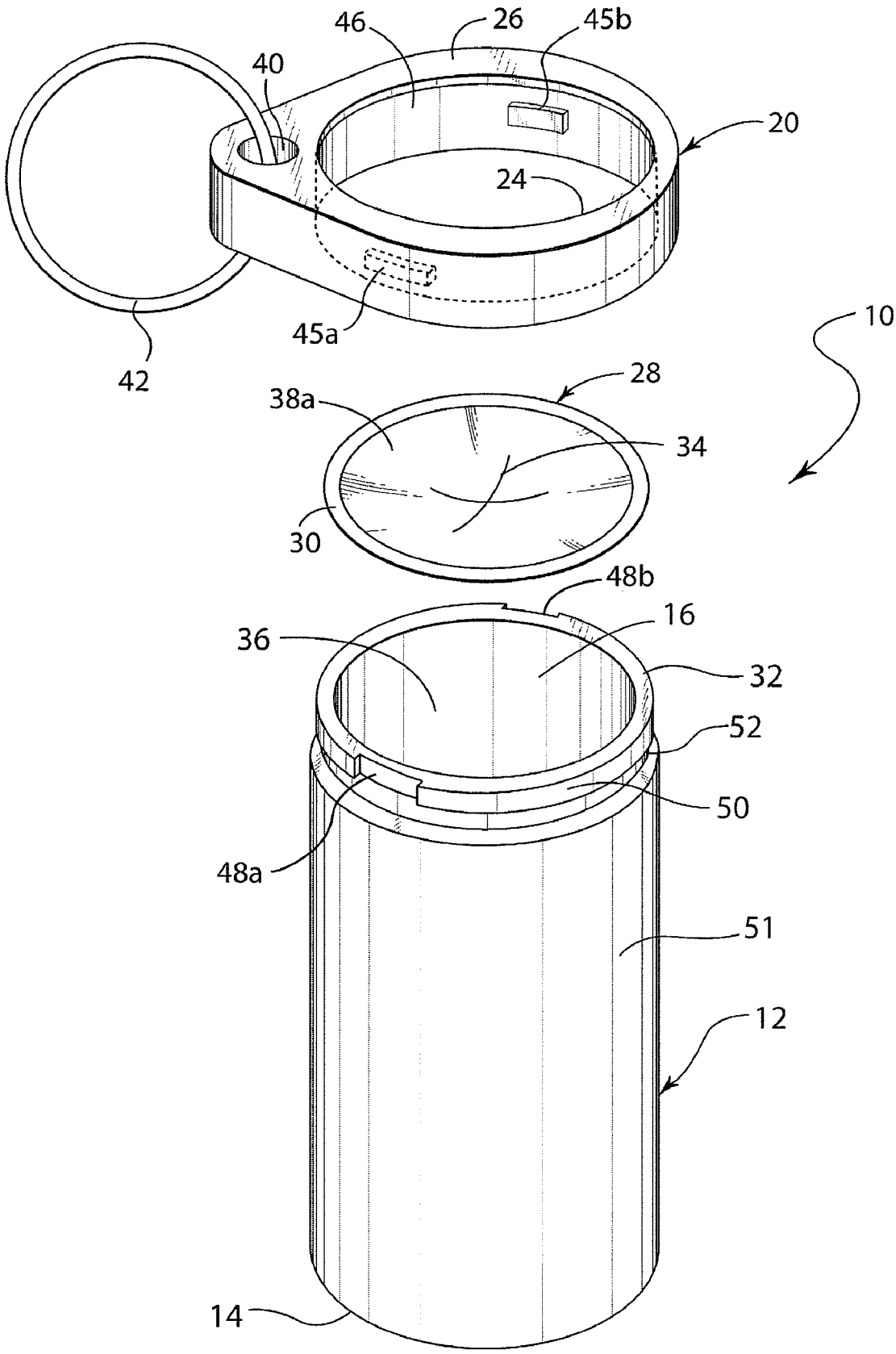

FIG. 1C is a schematic representation of an exploded projection view of another embodiment of container 10, illustrating septum 28 having a modified nipple-shaped or concave surface, 38, with "x" shaped slit or cut 34 therein. Cap 20 is adapted to be attached to body 12 using a twist-lock attachment mechanism. Projections, 45*a* and 45*b*, are disposed in interior portion, 46, of cap 20. Recesses, 48*a* and 48*b* in flange 50 formed in outer surface, 51, of body 12 are adapted to receive projections 45*a* and 45*b* such that cap 20 may be captured in groove, 52, when projections 45*a* and 45*b* are inserted into recesses 48*a* and 48*b*, respectively, as a result of body 12 being inserted into cap 20 and turned in either direction. Groove 52 may be tapered such that projections 45*a* and 45*b* are reversibly trapped as body 12 is turned, or a stop (not shown in FIG. 1C) may be provided to prevent a 180° turn of the body. As will be described hereinbelow, septum 28 remains with cap 20 when body 12 is removed therefrom.

Figure 1D:
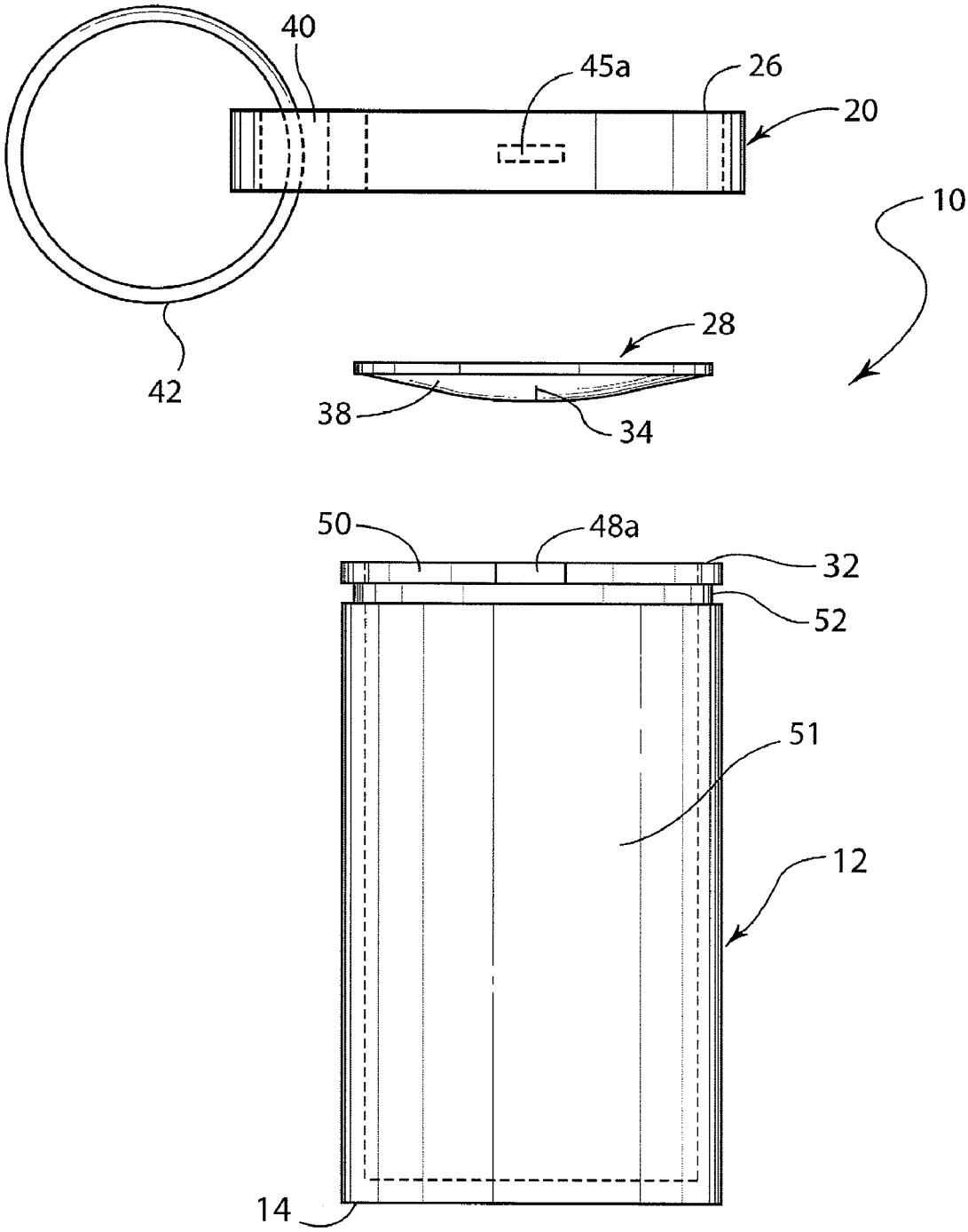

FIG. 1D is a schematic representation of a side view of the assembled container shown in exploded view in FIG. 1C hereof. Other means for attaching body 12 to cap 20 may also be envisioned.

Figure 2A:
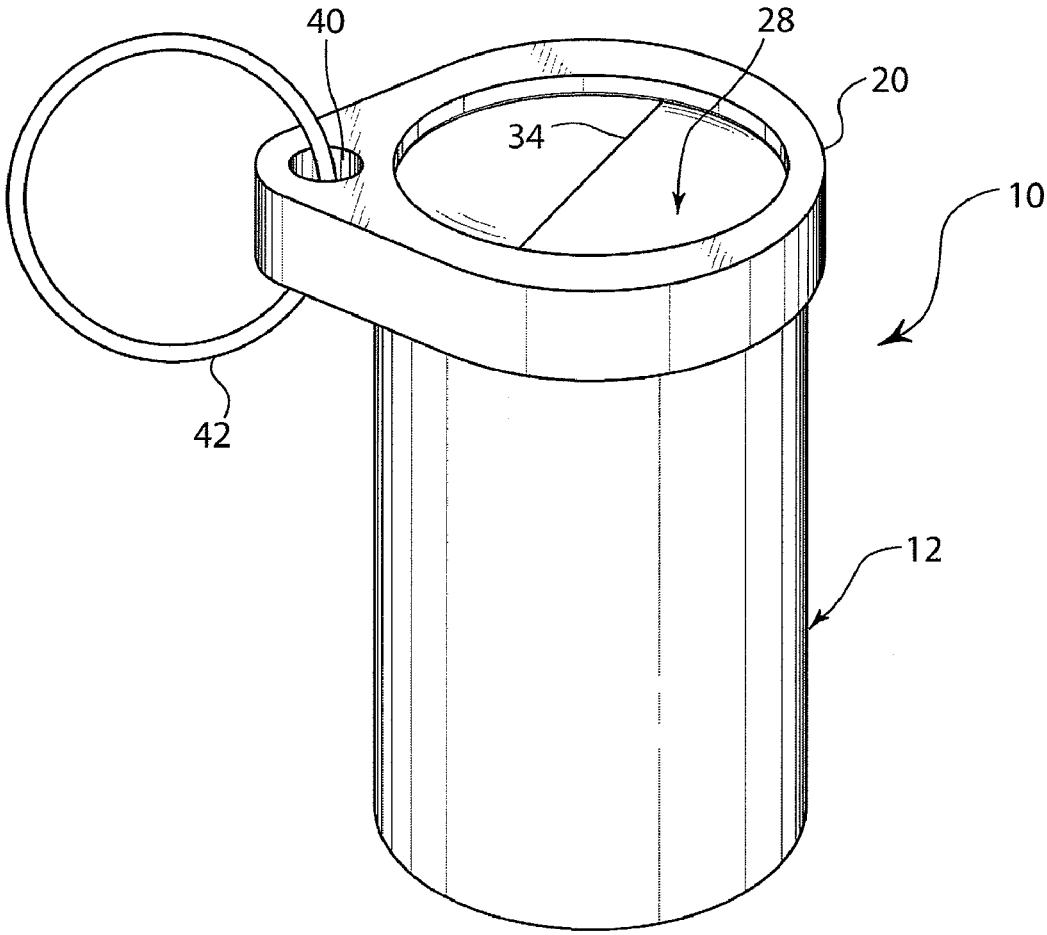
Figure 2B:
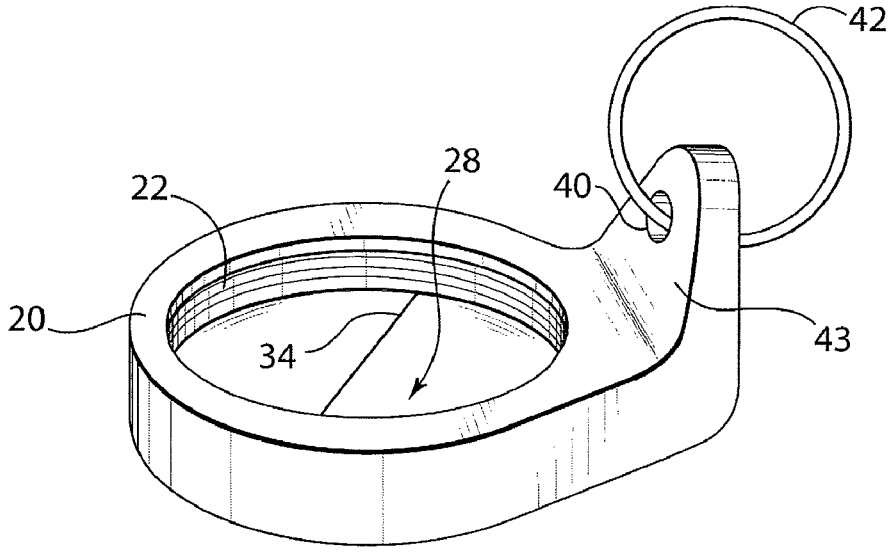
FIG. 2B is a schematic representation of a projection view of a screw embodiment of the cap, showing an upturned portion thereof for attaching the split ring such that the refuse container may be positioned more closely to the user thereof.

FIG. 2A is a schematic representation of a perspective view of assembled container 10 of the present invention shown in FIG. 1A hereof, while FIG. 2B is a schematic representation of a perspective view of a screw embodiment of cap 20, showing an upturned extended portion 43 for attaching split ring 42 such that the container may be positioned more closely to the user thereof.

Figure 3:
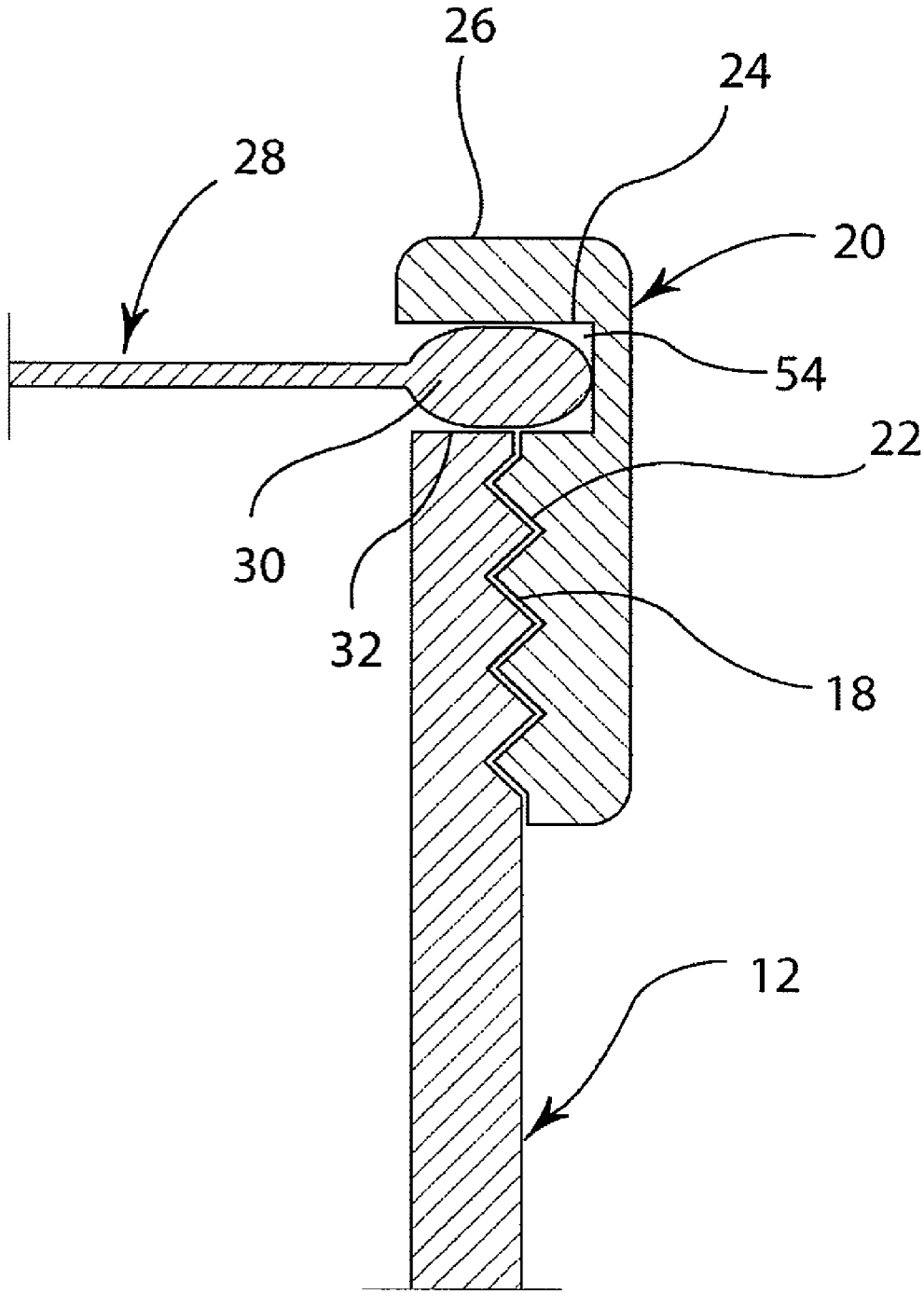
FIG. 3 is a schematic representation of a side view one embodiment of the manner in which the septum may be supported between the cylindrical body and the cap of the container, and the reversible retention of the ribbed or bulbous circumference of the septum by the cap in a groove adapted for this purpose.

FIG. 3 is a schematic representation of a side view of a screw-on embodiment of the present invention illustrating the manner in which septum 28 may be supported by body and cap 20 of container 10. Shown, is rib or bulbous portion 30 of septum 28 being wedged between inner surface 24 of flange 26 of cap 20 and substantially flat, top surface 32 of body 12, for support. Pocket or channel, 54, formed in cap 20 captures septum 28 such that when body 12 is detached from cap 20, septum 28 remains with cap 20. However, the present apparatus permits septum 28 to be readily removed from cap 20 for replacement.

Figure 4A:
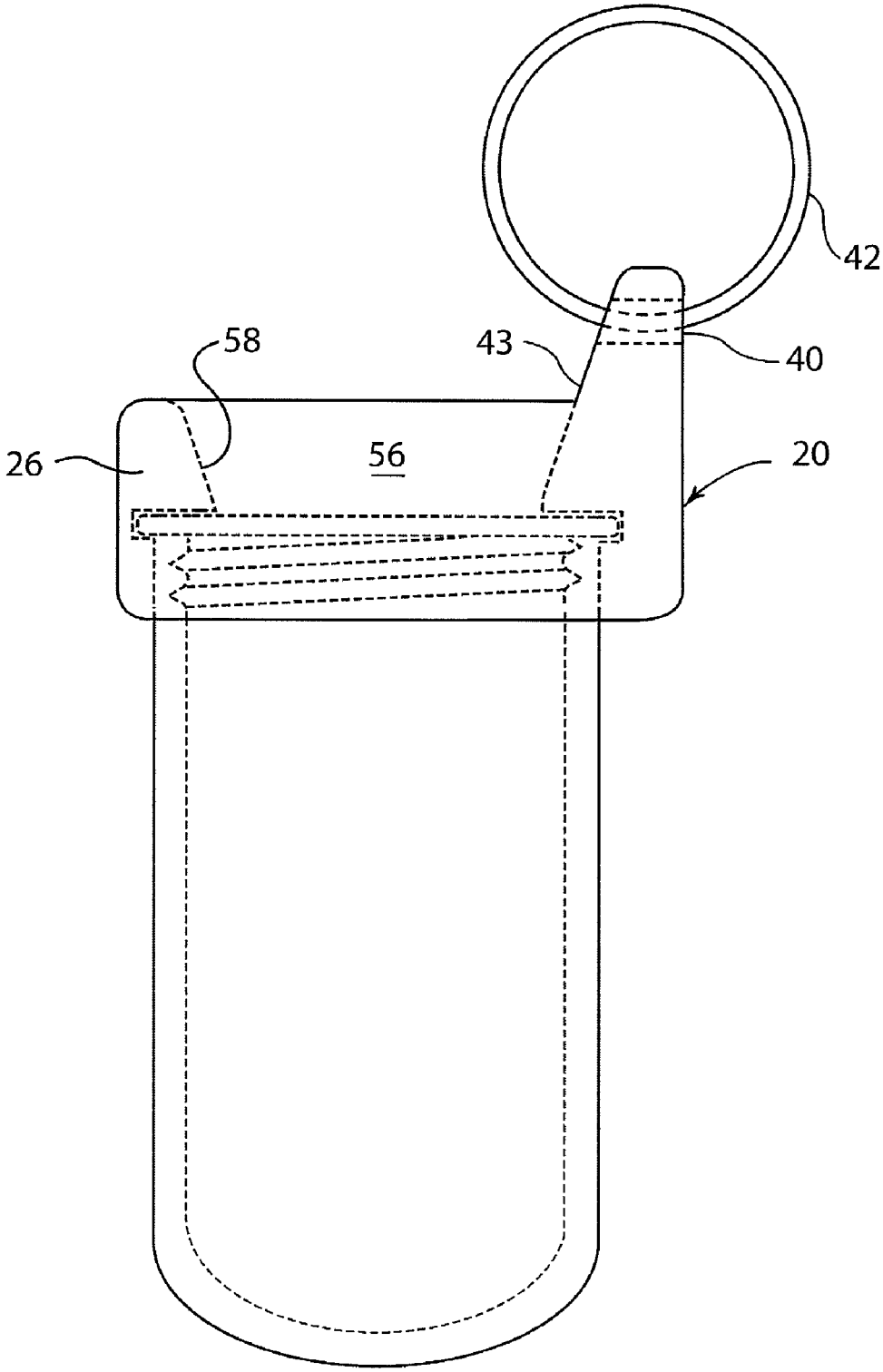
Figure 4B:
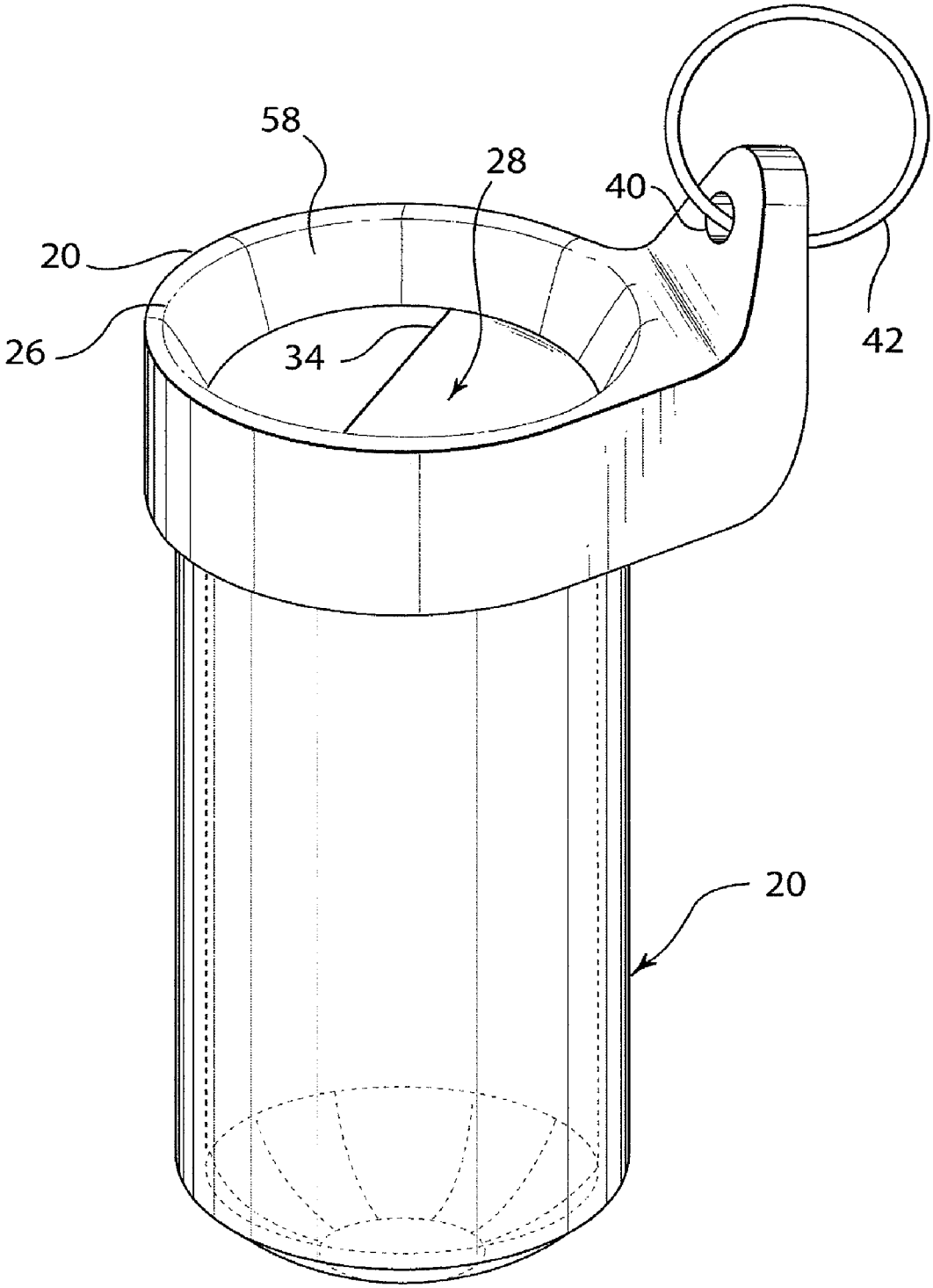
FIG. 4B is a schematic representation of a projection view of the container shown in FIG. 4A hereof.

FIG. 4A is a schematic representation of a side view of an embodiment of the present invention where funnel-shaped opening, 56, formed by tapered wall, 58, of the interior portion of flange 26 of cap 20, is formed for facilitating introduction of refuse into the container body through the septum or diaphragm, while FIG. 4B is a schematic representation of a perspective view of the container shown in FIG. 4A hereof.

In operation, a piece of waste leader or other material is inserted through split 34 in septum 28 and into interior 36 of the container by using a finger, a pencil or other stiff object to force open slit or perforation 34, after which the finger or other stiff object is removed from the opening and the slit or perforation is allowed to close, thereby securely trapping the refuse material for later disposal. With container 10 being attached to a vest or other garment, this operation may be performed using a single digit of one hand. Container 10 may be emptied at any time by unscrewing or otherwise detaching body 12 from cap 20, and the contents simply removed therefrom. As mentioned hereinabove, body 12 may be fabricated such that interior 36 terminates in rounded portion 44 on the inside of the body at closed end 14. If the approximate length of cylindrical body 12 between open end 16 and closed end 14 is that of an average adult finger, and the interior of the body is rounded, refuse removal therefrom may be facilitated by using a finger. Clearly, depending on the use intended and the intended location, the containers of the present invention may be fabricated in a variety of sizes and shapes.

Figure 5A:
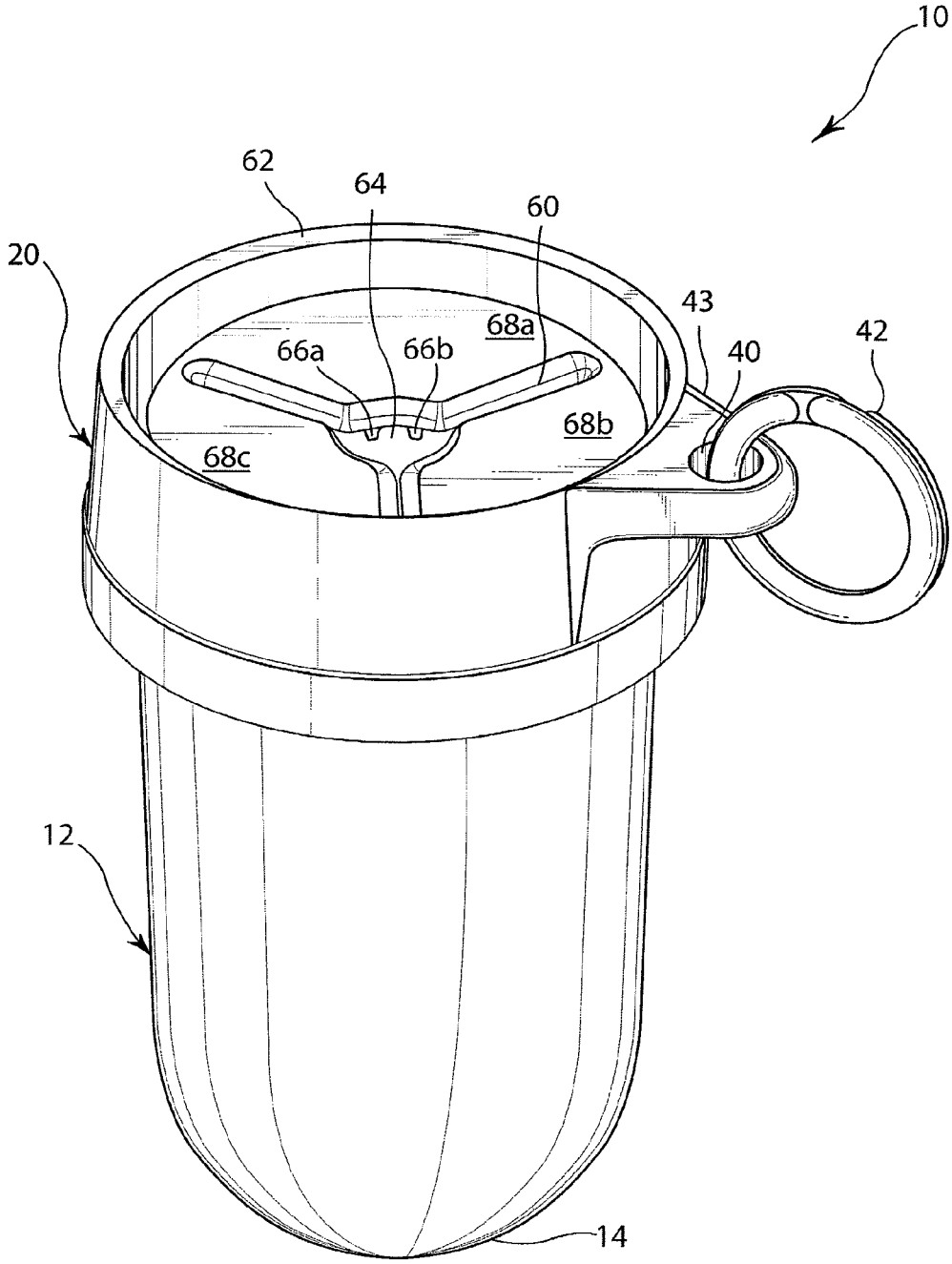

FIG. 5A is a schematic representation of a perspective view of yet another embodiment of container 10 of the present invention illustrating cylindrical body 12 having an open end and a closed end, cover or cap 20 adapted to be detachably affixed to the open end of the cylindrical body, having an open end and a closed end, a radial shaped slit or opening having arms in the form of a "Y," 60, in closed end, 62, thereof for inserting materials therethrough. Hole 40 in extended portion 43 of cover 20 permits a carrying mechanism, such as metal or plastic split ring, carabiner, snap hook, or other device 42, shown as a split ring in FIG. 5A, to be attached thereto for tethering container 10 to a zipper, tab, D-ring, and the like disposed on the user. Optional orifice, 64, may be provided in the closed end of cover 20 in the vicinity of the center or axis of the "Y" for inserting objects such as cigarette butts, as an example, and for increasing the scraping or scrubbing action of the portions of the slit on inserted fingers as they are withdrawn. Optionally, at least one tooth, 66*a* and 66*b*, may be provided on the underside of the each of the wedge-shaped sections or sectors, 68*a*-68*c*, formed by Y-shaped slit or opening 60 in cover 20 to augment the action of orifice 64 in removing waste fishing line and other materials from inserted fingers as they are withdrawn. Clearly, the slit may include additional radial arms in accordance with the teachings of the present invention.

Figure 5B:
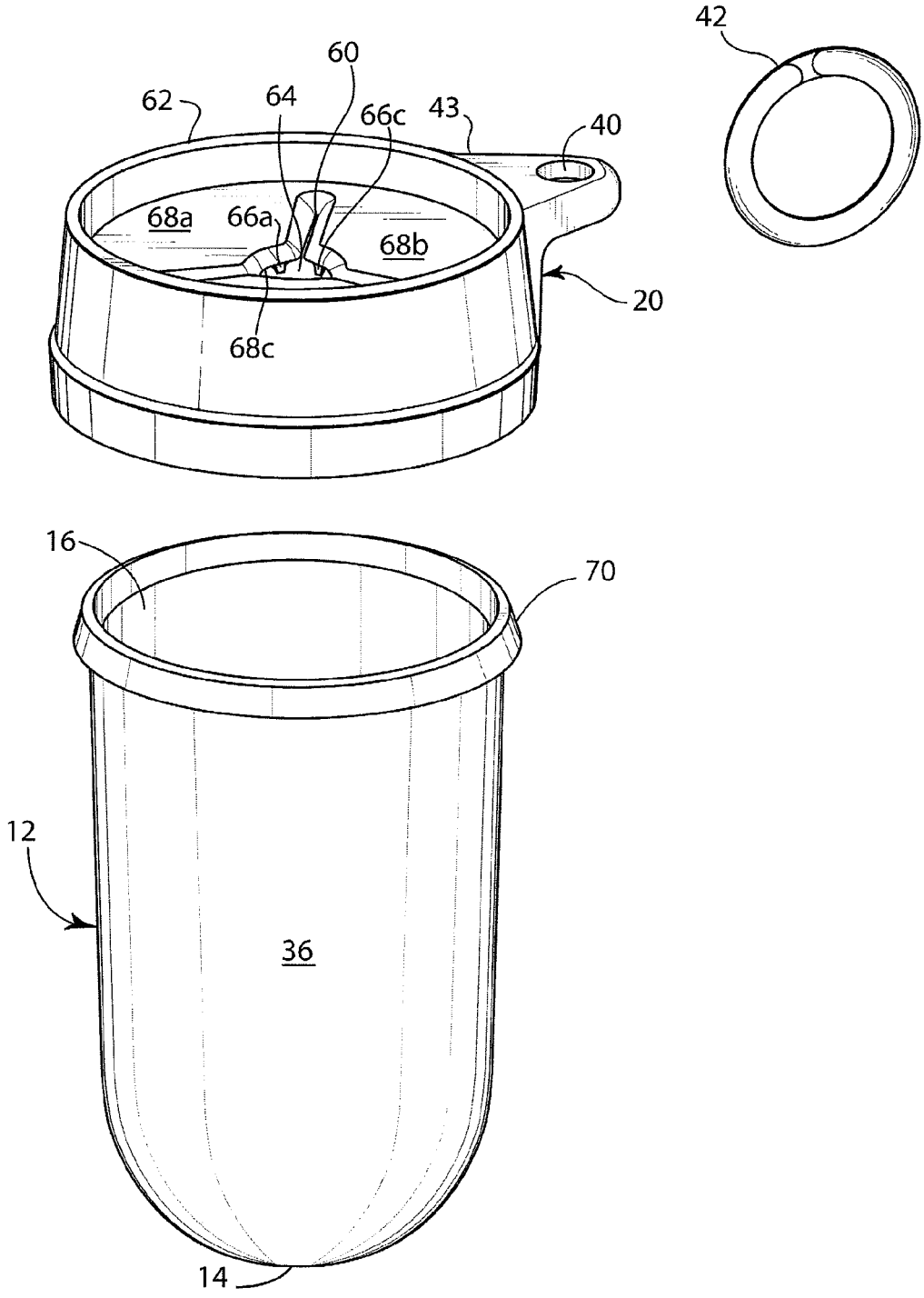
FIG. 5B is a schematic representation an exploded perspective view of the container shown in FIG. 5A hereof, illustrating a tapered lip formed on the outer surface of the body in the vicinity of the open end thereof.

FIG. 5B is a schematic representation an exploded perspective view of container 10 shown in FIG. 5A hereof, illustrating tapered lip, 70, in open end 16 of body 12. As will be discussed in more detail hereinbelow, tapered lip 70 engages a groove on the inner surface of cover 20 adapted to receive lip 70 when body 12 is inserted into cover 20. Body 12 is thereby removably attached to cover 20.

Figure 6A:
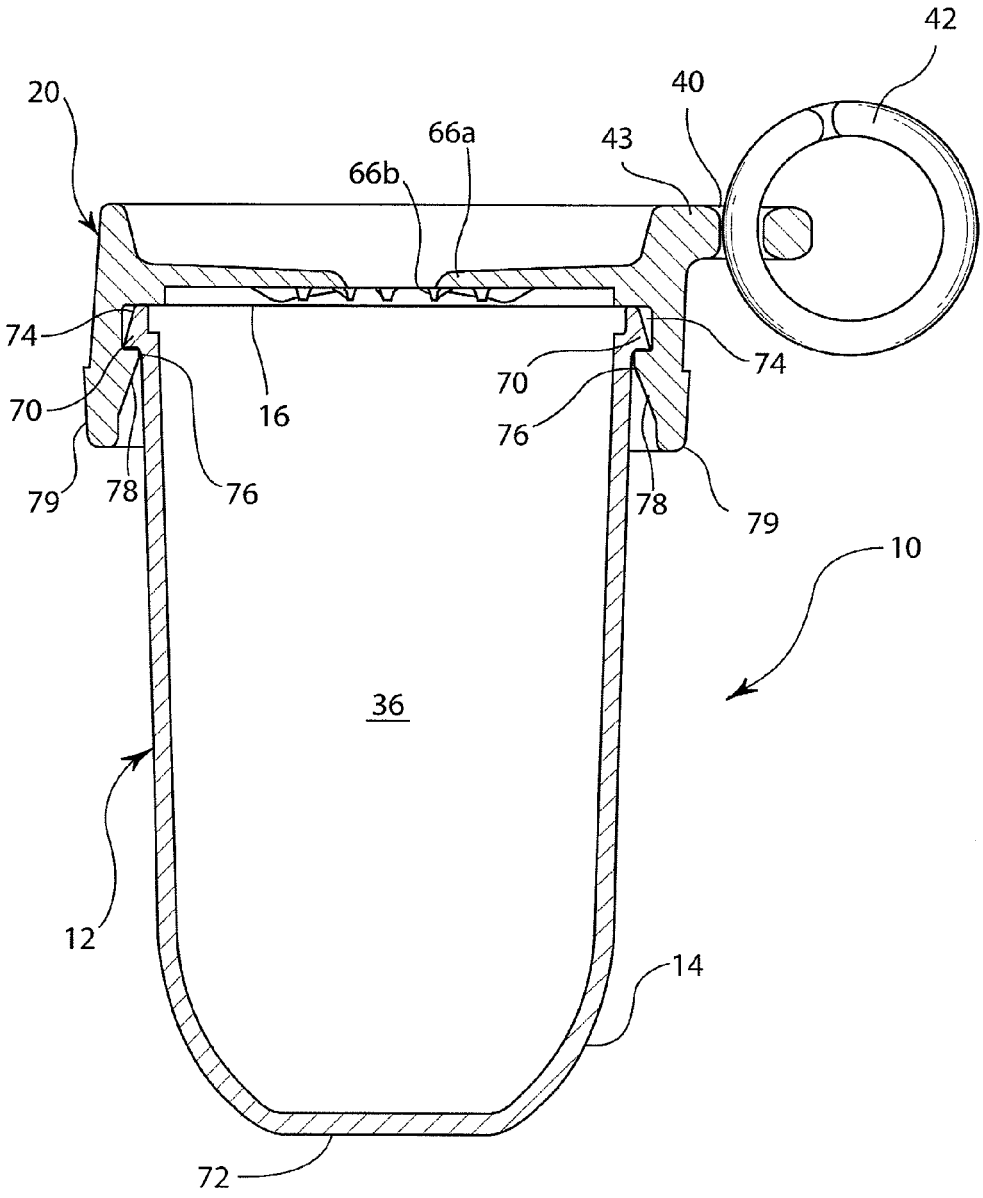
FIG. 6A is a schematic representation of a side view of a assembled container of the present invention shown in FIG. 5A hereof, showing the cylindrical body having a flat portion on the closed end thereof such that the container is self-supporting on a horizontal surface.

FIG. 6A is a schematic representation of a side view of assembled container 10 of the present invention shown in FIG. 5A hereof, showing cylindrical body 12 having an optional flat portion, 72, on the closed end thereof such that the container may be self-supporting on a flat surface. Groove, 74, formed in the inner surface, 76, of cover 20 is shown with tapered lip 70 of body 12 engaged therewith, thereby holding body 12 and cover 20 firmly and securely together. Taper, 78, in inner surface 76 of cover 20 facilitates removal of cover 20 from body 12 and installation of cover 20 onto body 12, both by enabling cover 20 to be more readily grasped by a user at flange, 79, and by guiding tapered lip 70 of body 12 into groove 74 of cover 12.

Figure 6B:
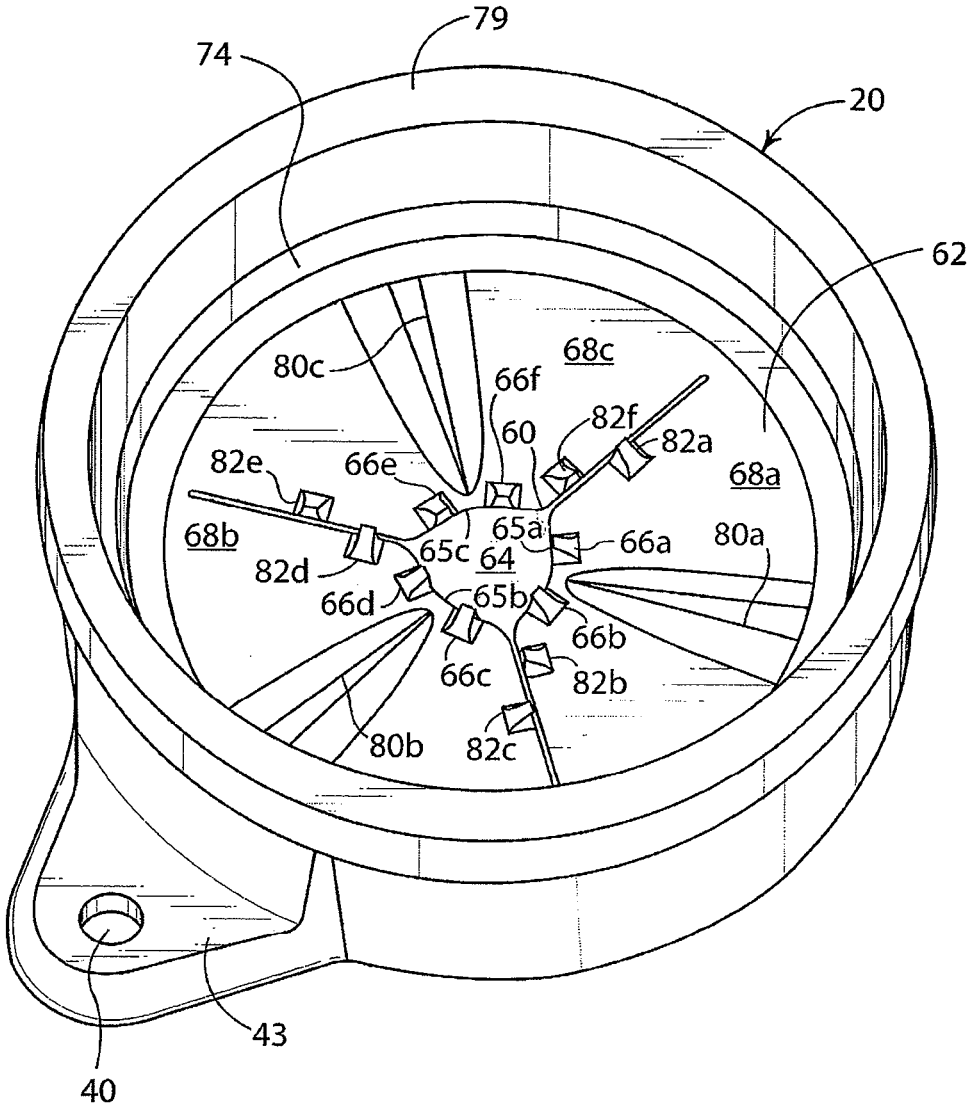
FIG. 6B is a schematic representation of a perspective view of the inside of the cover, showing optional stiffening ribs and optional teeth formed on the inside of the closed end of the cover on the wedge sections or sectors formed by the Y-shaped slit in the cover, an orifice formed in the vicinity of the axis of the "Y" for increasing the scraping or scrubbing action of the sectors on inserted fingers of a user and for enabling the easy insertion of cigarette butts and other small objects, and a groove on the inside surface for engaging the tapered lip of the container.

FIG. 6B is a schematic representation of a perspective view of the interior of cover 20, showing optional stiffening ribs, 80*a*-80*c*, and optional teeth formed on the inside of closed end 62 of the cover on wedge-shaped sections 68*a*-68*c*, respectively, formed by Y-shaped slit 60 in the cover, and groove 74 on the inside surface for engaging tapered lip 70 of container 12. Additional teeth, 82*a*-82*f*, may be formed on the side edges of wedge-shaped sections 68*a*-68*c*, respectively, in order to improve the grabbing efficiency of cover 20 for fishing line or leader disposed on one or more fingers of a user. It should be mentioned that edges 65*a*-65*c* of orifice 64 have been found to improve the scraping and scrubbing action of sectors 68*a*-68*c*, respectively, in addition to permitting insertion of small objects such as cigarette butts. Further, edges 65*a*-65*c* are not required to be circular, but may have any curved shape that assists in the scraping and scrubbing properties of the sectors when inserted fingers are removed therefrom.

Figure 6C:
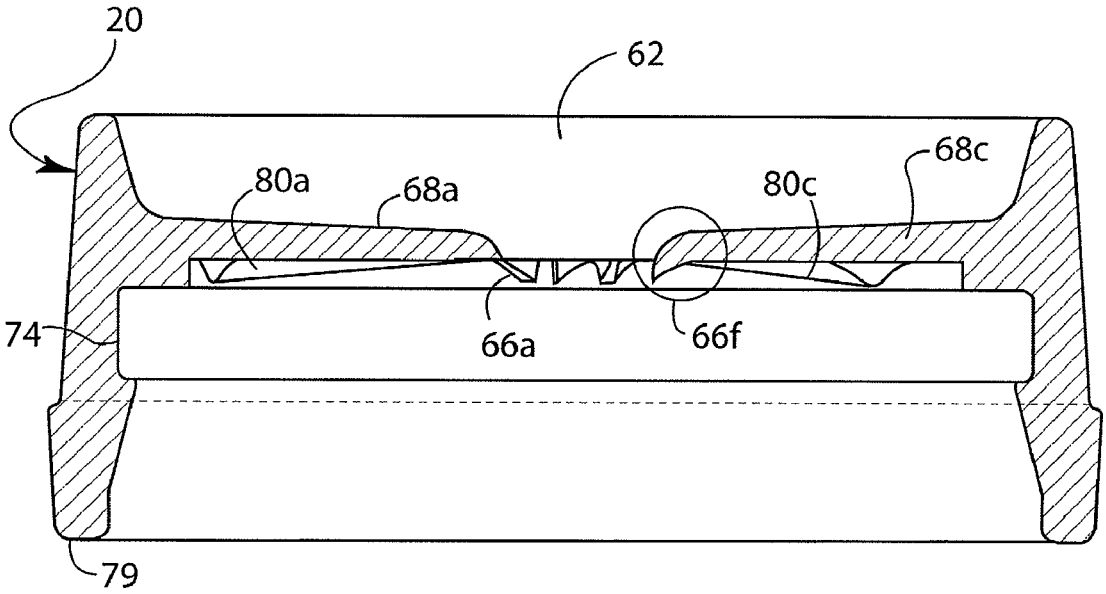
FIG. 6C is a side view of the cover shown in FIG. 6B hereof, illustrating in more detail the ribs and teeth formed in the closed end of the cover.
Figure 6D:
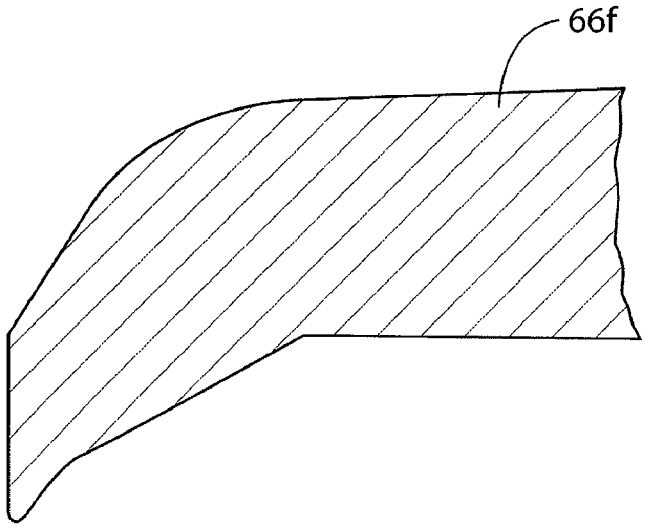
FIG. 6D shows a more detailed view of a side view of one of the teeth formed in one of the sectors.

FIG. 6C is a side view of cover 20 shown in FIG. 6B hereof, illustrating in more detail ribs 80*a* and 80*c*, and teeth 66*a* and 66*f* formed in closed end 62 of the cover, while FIG. 6D shows a more detailed view of a side view of tooth 66*f* formed in wedge-shaped portion 68*c*.

Figure 7:
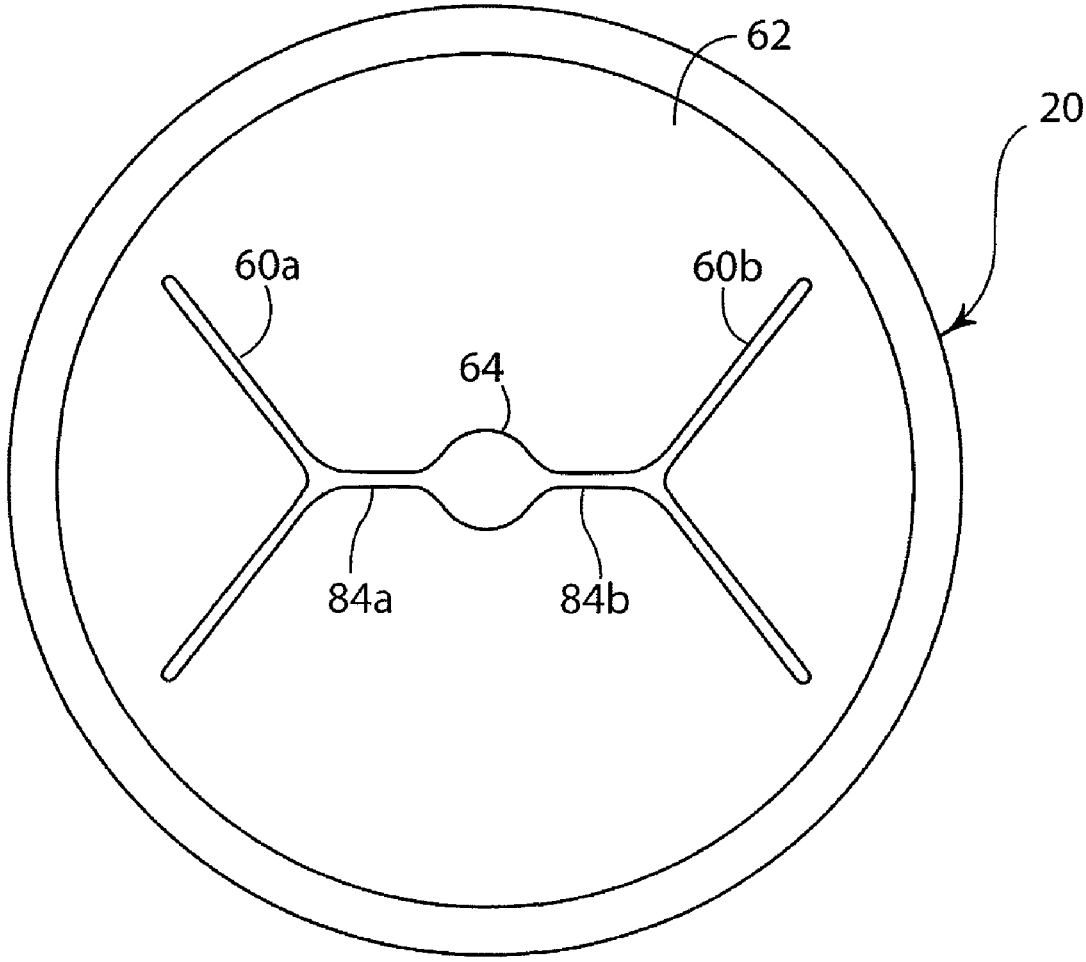
FIG. 7 is a schematic representation of a top view of another embodiment of the cover of the present invention, wherein two Y-shaped slits, each slit having one leg collinear with a corresponding leg of the other Y-shaped slit, are shown in the closed end of the cover for permitting material to be inserted into the cylindrical body using one or more fingers.

FIG. 7 is a schematic representation of a top view of another embodiment of the cover of the present invention, wherein two Y-shaped slits, 60*a* and 60*b*, each slit having one leg, 84*a* and 84*b*, respectively, collinear, with the corresponding leg of the other slit are shown in closed end 62 of cover 20, for permitting material to be inserted into the cylindrical body (not shown in FIG. 7) using one or more fingers of one hand. Optional orifice 64 may be inserted between the Y-shaped slits in order to facilitate introducing cigarette butts into the container. The two Y-shaped slit design may be used for larger container designs adapted for fitting into cup holders disposed in cars and boats, as examples.

Body 12 of the embodiments of the invention illustrated in FIGS. 5-7 may be fabricated from a durable plastic such as polycarbonate or polyethylene terephthalate, as examples, while cover 20 may be fabricated from deformable materials such as polyurethane, sanoprene, rubber or silicone, or similar polymeric materials, as examples, having a Shore A durometer value between 25 and 75. For less stiff, but more rubbery and sticky polymers, ribs 80*a*-80*c* may be used to stiffen wedge-shaped portions 68*a*-68*c*.

In operation, for the embodiments of the invention shown in FIGS. 5-7 hereof, is held in a generally upright position, with the cover end disposed above the body. A piece of waste leader or other material may be inserted through Y-shaped slit 60 in closed end 62 of cover 20 and into interior 36 of body 12 by using one or more fingers, a pencil or other stiff object to force open slit or perforation 60, after which the one or more fingers or other stiff object may be removed from the opening and the slit or perforation is allowed to close, thereby securely trapping the refuse or other materials for later disposal or other use, respectively. Optional teeth 66*a*-66*f* may grab the fishing line, thereby easing its removal from the at least one finger. With container 10 being attached to a vest or other garment in an upright configuration, this operation may be performed using a single digit from one hand. Container 10 may be emptied at any time by detaching body 12 from cap 20, and the contents simply removed therefrom. Body 12 may be fabricated such that interior 36 terminates in a rounded portion on the inside surface of the body from closed end 14. If the approximate length of cylindrical body 12 between open end 16 and closed end 14 is that of an average adult finger, and the interior of the body is rounded, material removal therefrom may be facilitated by using a finger in a swiping motion. Clearly, depending on the use intended and the intended location, the container of the present invention may be fabricated in a variety of sizes and shapes. For example, the embodiment of cover 20 shown in FIG. 7 hereof may be adapted to fit cup-size containers, secured on a boat or personal water craft, as examples. Other shapes for the containers, such as square or rectangular may be envisioned for strapping to the gunwales of a boat, as an example.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A container comprising in combination:

a hollow, cylindrical body having an open end and a closed end, an inner surface and an outer surface, the outer surface having a circular lip formed in the vicinity of the open end of said body;

a cover having a closed end and an open end, wherein a portion of the closed end is circular and is adapted for covering the open end of said body, said cover further being deformable, having a slit therethrough through which items can be inserted, having an extended portion through which a hole is placed for attaching said cover to other objects, and having a cylindrical inner surface in which a circumferential groove is disposed and adapted to receive the circular lip in said hollow body, whereby said cover is removably attached to said hollow body; and wherein the slit is Y-shaped and has at least three, radially disposed arms emanating from the vicinity of the center of the circular portion of said cover, the arms dividing the circular portion of said cover into three, generally wedge-shaped sections, and wherein the wedge-shaped sections have stiffening ribs.

2. A container comprising in combination:

a hollow, cylindrical body having an open end and a closed end, an inner surface and an outer surface, the outer surface having a circular lip formed in the vicinity of the open end of said body;

a cover having a closed end and an open end, wherein a portion of the closed end is circular and is adapted for covering the open end of said body, said cover further being deformable, having a slit therethrough through which items can be inserted, having an extended portion through which a hole is placed for attaching said cover to other objects, and having a cylindrical inner surface in which a circumferential groove is disposed and adapted to receive the circular lip in said hollow body, whereby said cover is removably attached to said hollow body; and wherein the slit is Y-shaped and has at least three, radially disposed arms emanating from the vicinity of the center of the circular portion of said cover, the arms dividing the circular portion of said cover into three, generally wedge-shaped sections, and wherein at least one of the wedge-shaped sections has at least one stiffening rib disposed radially from the vicinity of the center of the circular portion of said cover.

3. A container comprising in combination:

a hollow, cylindrical body having an open end and a closed end, an inner surface and an outer surface, the outer surface having a circular lip formed in the vicinity of the open end of said body;

a cover having a closed end and an open end, wherein a portion of the closed end is circular and is adapted for covering the open end of said body, said cover further being deformable, having a slit therethrough through which items can be inserted, having an extended portion through which a hole is placed for attaching said cover to other objects, and having a cylindrical inner surface in which a circumferential groove is disposed and adapted to receive the circular lip in said hollow body, whereby said cover is removably attached to said hollow body; and wherein the slit is Y-shaped and has at least three, radially disposed arms emanating from the vicinity of the center of the circular portion of said cover, the arms dividing the circular portion of said cover into three, generally wedge-shaped sections, and wherein at least one of the wedge-shaped sections has at least one tooth directed toward said body.

* * * * *